United States Patent [19]

Miller

[11] 4,219,513

[45] Aug. 26, 1980

[54] METHOD AND MEANS OF CONSTRUCTION OF CONCRETE CULVERTS

[76] Inventor: Coston B. Miller, 2403 Glenn St., Huntsville, Ala. 35801

[21] Appl. No.: 963,838

[22] Filed: Nov. 27, 1978

Related U.S. Application Data

[62] Division of Ser. No. 814,560, Jul. 11, 1977, Pat. No. 4,142,705.

[51] Int. Cl.[2] ..... E01G 4/00

[52] U.S. Cl. ..... 264/32; 249/11; 264/34

[58] Field of Search ..... 249/10–12; 264/34, 32

[56] References Cited

U.S. PATENT DOCUMENTS

| | | | |
|---|---|---|---|
| 3,277,556 | 10/1966 | Plott et al. | 264/35 X |
| 3,696,177 | 10/1972 | Holland | 249/11 X |

*Primary Examiner*—Thomas P. Pavelko
*Attorney, Agent, or Firm*—C. A. Phillips

[57] ABSTRACT

A method and means of improved construction of concrete culverts in which reinforcement bars are supported by removable racks until the bottom of the culvert is poured and interior wall forms are mounted on wheels with side wall forms pivoting with respect to the top wall form. By this combination of features, a very rapid setting of reinforcement bars and wall forms may be accomplished, and rapid removal of re-bar supports and the interior forms may be effected.

1 Claim, 8 Drawing Figures

METHOD AND MEANS OF CONSTRUCTION OF CONCRETE CULVERTS

This is a division of application Ser. No. 814,560 filed July 11, 1977, now U.S. Pat. No. 4,142,705.

BACKGROUND OF THE INVENTION

1. Field of the Invention

This invention relates to the construction of concrete structures, and particularly to an assembly and means for pouring reinforced rectangular concrete structures.

2. General Description of the Prior Art

The construction of culverts and other rectangular cross section masonry structures typically requires that before concrete can be poured a maze of forms and reinforcement bar supports must be set and aligned and secured in place. Until now, the general practice has been to construct with lumber custom frameworks for each section of a structure, and then where additional sections are required, repeat the process one or many times until all sections are poured. This process is extremely costly, and it is the object of this invention to provide a system of removable supports and forms which may be rapidly put in place, removed, and reinstalled to effect a greatly expanded rate of construction with the same manpower, and, of course, to effect a substantial saving in cost.

SUMMARY OF THE INVENTION

Once the outside wall forms of a rectangular cross section structure are set, reinforcement bar (hereinafter referred to as re-bar) beam hangers are simply placed over and supported by the top of the side wall panels. These hangers include an L-shaped assembly for support on the forms and U-shaped re-bar beam holders extending inward, and re-bar holding beams are locked in these holders. Then, lateral riser beam supports are connected between bottom portions of the hangers on opposite side forms, and riser beams are then interconnected between the lateral beams, the riser beams being spaced just inward of the wall forms. Next, U-shaped re-bars are placed over the re-bar holding beams, the re-bar holding beams having on a top side guides which space the re-bars at selected spacings. With floor re-bars in place, the floor of the structure is poured, leaving concrete risers corresponding to the wall thickness of the walls, to be later poured. The hangers and beams are now rapidly removed. Next, a mobile interior wall form assembly with pivoting side walls is moved into the structure, and the bottom of the side walls is pivotally moved and blocked in place against the risers. With all horizontal re-bars in place in the to-be-poured top, the side walls and top are now poured. After the concrete is set, the mobile wall form assembly is unblocked and removed from the thus poured structure.

DETAILED DESCRIPTION OF THE DRAWINGS

Figures 1, 8:
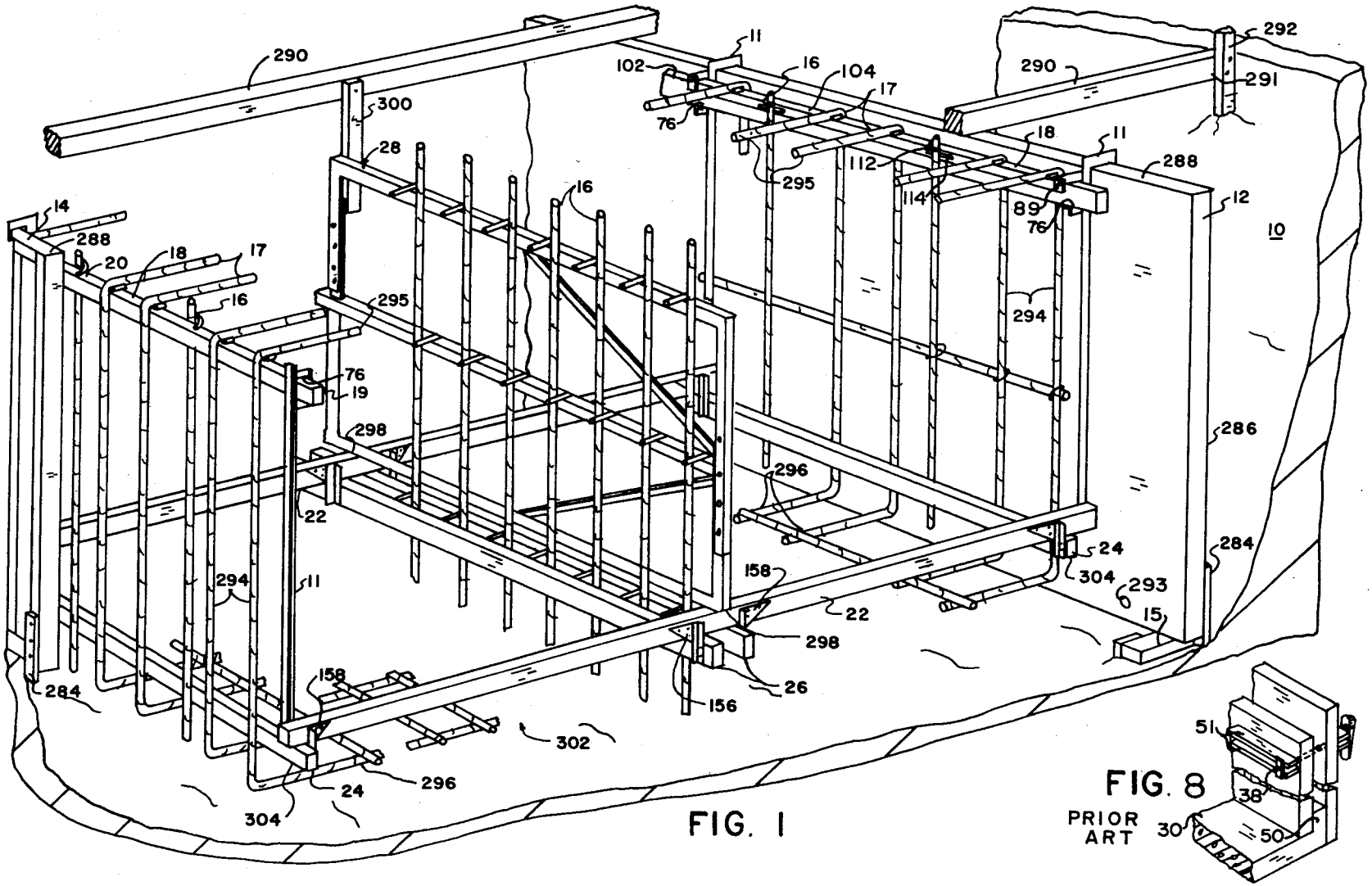
FIG. 8 PRIOR ART
FIG. 1 is a pictorial view of an excavation site illustrating the re-bar holding system of this invention.
FIG. 8 is an illustration of an aspect of the prior art.

Referring to FIG. 1, there is shown a partial view of the site where a culvert is to be constructed. As shown, an excavation 10 is made of a desired depth and width to accommodate the required outside walls 12 and 14, between which two drainage openings, otherwise called barrels, of a culvert are to be integrally formed of concrete. The required reinforcing bars 16 and 17 are shown in place, being supported by devices in accordance with the present invention.

Following is a step-by-step procedure for supporting re-bars according to prior art methods:

1. Heretofore, racks for supporting exterior or outside wall supporting re-bars 16 and 17 were simply formed of wooden beams 19. These beams were placed in the same position as removable racks 18 and 20, shown in FIG. 1, and were supported by spaced blocks or cleats which were nailed to a wall, and to which beams 19 were then supported as by nails.

2. Re-bars 16 and 17 were then spaced and hung over beams 19.

3. Lateral beams, such as beams 22 shown in FIG. 1, extended between exterior walls 12 and 14 and were supported by short strips or cleats which were nailed to walls 12 and 14 and to each end of beams 22.

4. Longitudinal riser forms 24 and 26, which consist of longitudinal beams, were then properly spaced and first toe-nailed to lateral beams 22, to which they were then suitably braced so as to support concrete.

5. A central support rack 28 was then constructed of wood which was of suitable height and length to support interior wall re-bars 16. Re-bars 16 were then spaced and attached by wire ties or nails to one side of rack 28.

6. Once re-bars 16 were thus supported, concrete was placed to form floor 30 (FIG. 7) and concrete risers 46, 48, and 50 and then allowed to harden or cure.

7. Once floor 30 was completed (FIG. 1), re-bar supports 18 and 20 were removed as was central rack 28 (FIG. 1). Risers 24 and 26 were pried loose from beams 22, after which lateral beams 22 were removed in a similar manner.

8. Holes were drilled in outer walls 12 and 14 for through rods 38, known in the art as snap ties (FIG. 8), then inside wall forms were placed with a lower side region of each in contacting engagement with one vertical edge of risers 46, 48, and 50.

9. Holes were drilled through inside walls or forms which mated with the previously drilled holes in outer walls 12 and 14. Snap ties 38 were then placed through mating walls.

10. Whalers 51 (FIG. 8) were formed of spaced longitudinal beams between which the snap ties were inserted.

11. Snap ties through whalers and walls thus supported the interior and exterior vertical walls of each culvert form.

12. Joists for the top deck were then placed atop interior and exterior walls.

13. Decking, weep hole forms 250 (FIG. 7), and re-bars for the top and walls of a culvert were placed and secured.

14. Concrete was then placed in outer and central wall forms to a depth above the deck which was level with the upper end of weep hole forms 250 and allowed to set.

15. Vertical supports were then inserted between floor 30 and joists of the deck. Vertical inside walls or forms were then removed.

16. The upper deck was then lowered and removed.

Figures 2, 3, 4, 5:
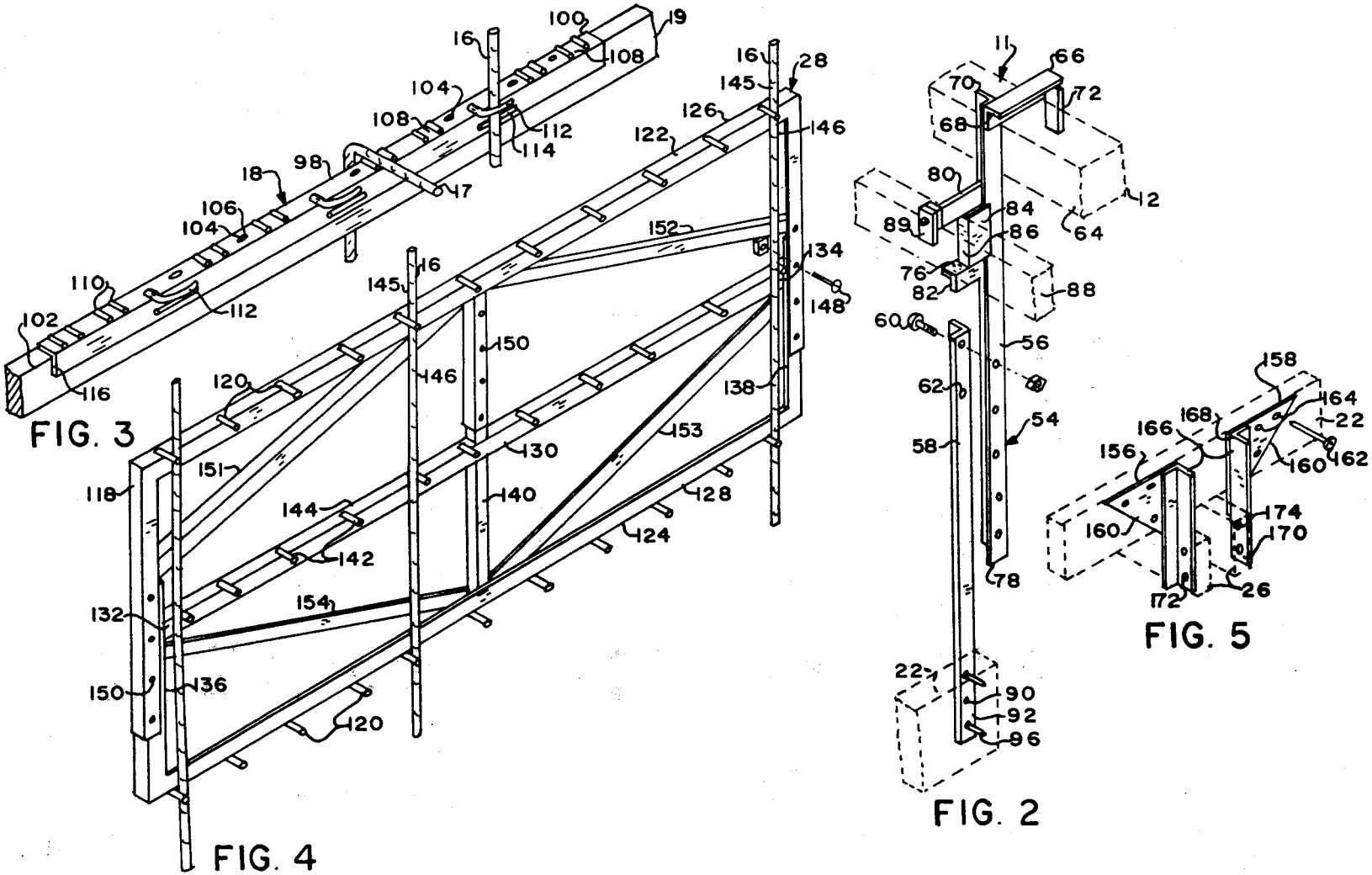
FIG. 2 is an exploded pictorial view of a re-bar beam holding bracket as contemplated by this invention.
FIG. 3 is a pictorial view illustrating the re-bar holding beam as contemplated by this invention.
FIG. 4 is a re-bar holding frame for holding the bars when not positioned to a fixed wall form.
FIG. 5 is a pictorial view of brackets particularly adapted to support riser forming beams on lateral beams extending between the brackets shown in FIG. 1.

Referring to FIG. 2, there is shown a pictorial view of hanger assembly or bracket 11 which is a primary supportive element of the system. Bracket 11 is largely formed from lengths of angle material and includes an elongated vertical body 54 having upper and lower members 56 and 58. These members are adjustably coupled by bolts 60 through mating holes 62. Upper member 56 of bracket 11 is securely supported to one side 64 of wall 12 by L-shaped member 66 having one leg 68 secured normal to upper end region 70 of body member 56, and a second leg 72 projecting downward to closely engage the opposite side 74 of wall 12. A vertical slot 76, positioned intermediate of ends 70 and 78 of body member 56, is formed of vertically spaced horizontal angles 80 ad 82 and a third angle member 84 which serves as the inner wall 86 of slot 76. Slot 76 is typically dimensioned to accept a readily available timber 88, such as a 2×4 which is removably secured by rotary latch 89.

Spaced holes 90 are drilled through lower end region 92 of body member 58, through which lateral beam 22 (FIG. 1) is attached, as by spikes 96 (FIG. 2). Re-bars 16 and 17, which reinforce the exterior vertical walls of a culvert, are supported by longitudinal rack 18 (FIG. 3). Body 98 of rack 18 consists of an elongated angle 100 which is engaged over an upper inside corner 102 of each longitudinal beam 19 and attached thereto by spikes 104 through spaced holes 106. U-shaped re-bars 17 are supported and aligned by slots 108 which are formed by lateral cleats 110, being spaced to accept a selected size re-bar 17. Straight vertical re-bars 16 are frictionally supported by L-shaped hooks 112 which firmly engage re-bars 16 with heels or cleats 114, spaced under hooks 112 and attached to vertical flange 116 of angle 100.

Straight re-bars 16, which reinforce each intermediate wall of a culvert, are frictionally supported by vertical rack 28 (FIG. 4). Rack 28, typically fabricated from lengths of angle bar, includes a rectangular frame 118. Symmetrically spaced pins 120 are secured to horizontal flanges 122 and 124 of upper and lower angle bars 126 and 128 of frame 118 which extend laterally to a length so as to engage re-bars 16. An intermediate longitudinal angle bar 130 is supported at each end 132 and 134 to vertical connecting anble bars 136 and 138, being also further supported to central vertical cross member 140. Laterally projecting pins 142 are secured to horizontal flange 144 of angle bar 130 which are spaced similar to pins 120 but are displaced slightly to the left as viewed in FIG. 4. One surface 145 of each re-bar 16 is engaged with pins 120 and is then centrally deflected such that the opposite surface 146 is frictionally engaged over a pin 142, thus providing substantial support for each re-bar 16. To provide an adjustment of the frictional force provided by pins 142, angle bar 130 may be made longitudinally adjustable. Further, in order to permit a different spacing between rods, a second set of pins 120 and 142 may be supported by the other flange of angle bars 126, 138, and 130 and the ends of these angle bars rotably attached to vertical angle bars 136 and 138.

Vertical members 136, 138, and 140 are joined by bolts 148 through holes 150 so that rack 28 may be adjusted to a preselected height. Skew of frame 118 is prevented by corner braces 151, 152, 153, and 154. Referring back to FIG. 1, riser forms 24 and 26 are held in spaced relationship by vertical support brackets 156 and 158 (FIG. 5). Each bracket 156 and 158 includes triangular plate 160 which is attached to lateral beams 22, as by spikes 162, through holes 164. A vertical support member 166 is formed from a short angle bar having an upper end region 168 secured to triangular plate 160. A lower end region 170 extends downward the width of riser form 26 and is secured thereto by spikes 172 driven through holes 174.

Figure 6:
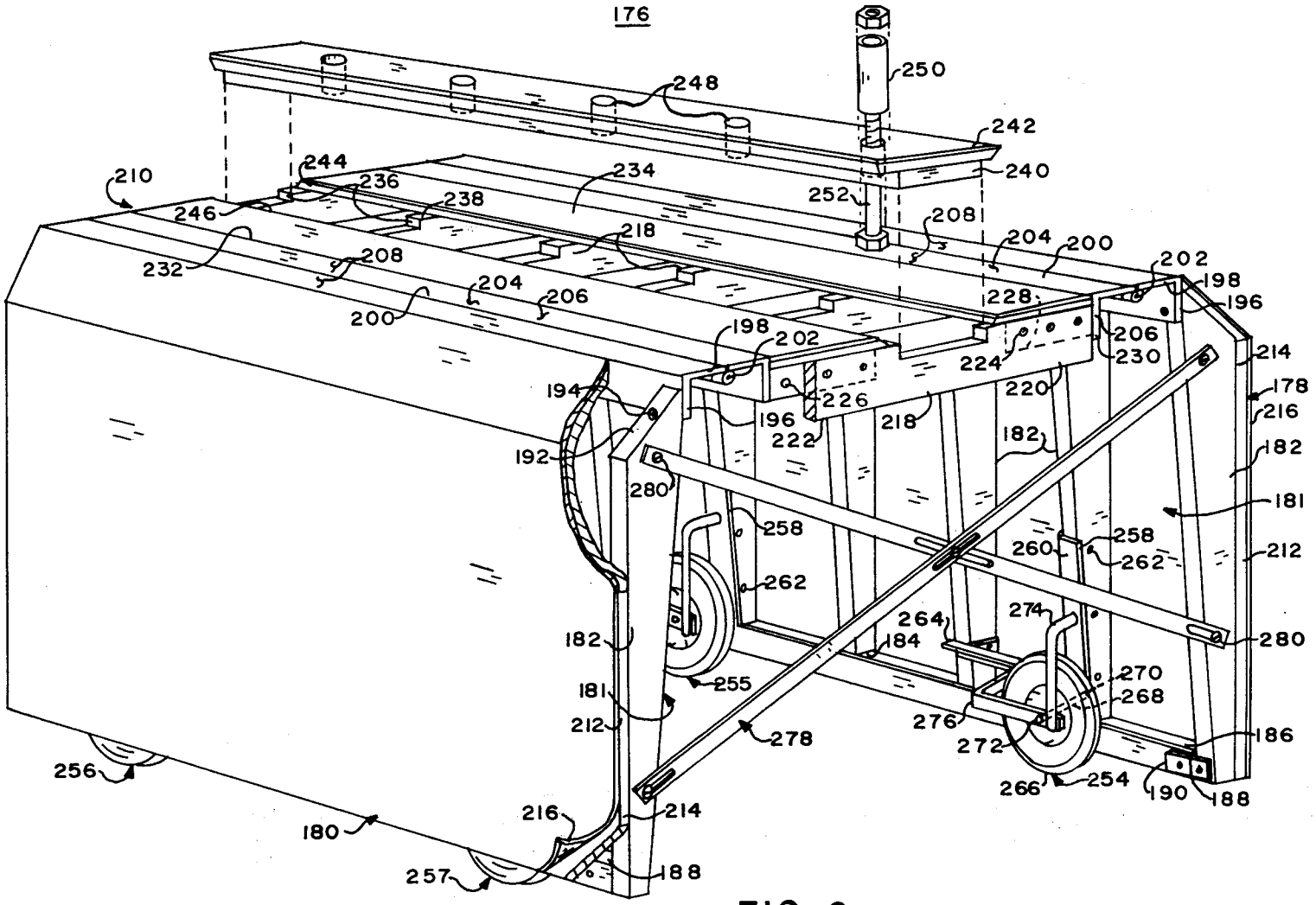
FIG. 6 is a pictorial view of a mobile interior wall assembly as contemplated by this invention.

A mobile interior form or mold 176 is shown in FIG. 6 which is fabricated in accordance with this invention. Each of side walls 178 and 180 of form 176 includes an interior framework 181 having spaced risers or ribs 182 which are supported at the lower end 184 by a longitudinal angle runner or beam 186. Beam 186 is in turn supported by end rib 182 at each end 188 by strap member 190. Upper end region 192 of each rib 182 is secured edgewise by bolt 194 to downwardly extending flange 196 of angle 198 of each wall 178 and 180. Horizontal flange 200 of each angle 198 is pivotally interconnected by conventional hinges 202 in close abutting relationship to horizontal flange 204 of a second angle 206. Upper surface 208 of angles 198 and 206 thus provide a portion of deck cover assembly 210 of mobile form 176. Exterior covering 212 of side walls 178 and 180 includes a first layer 214 of material, such as plywood or heavy board, supported by ribs 182, which is then covered with an outer skin member 216 of thin metal or other suitable material.

Top wall or deck assembly 210 of form 176 is supported by a plurality of spaced lateral beams 218 of selectable length. Outer end regions 220 and 222 of beams 218 are secured by bolts 224 to metal straps 226 and 228 which are attached, as by welding, and in a posture normal to downward flange 230 of angles 206. Straps 226 and 228 are vertically positioned so as to carry intermediate deck segments 232 and 234 flush with surface 208 of angles 206. Deck segments 232 and 234 are formed in a similar manner to covering 212 of side walls 178 and 180 as described above. Notches 236, centrally formed in upper edge 238 of joists 218, are sized to accept longitudinal supporting beam 240, which in turn provides additional support for central closing deck member 242. Central closing member 242 is of a width which is selected in accordance with the selected length of joists or beam 218, and is of a width to exactly fit between deck segments 232 and 234, being tapered along the edges so as to be easily separated from mating edges 244 and 246 of upper deck members 232 and 234. Spaced vertical holes 248, formed through beam 240 and cover 242, provide a means of attaching weep hole forming tubes 250, to be described, to bolt and nut assembly 252.

Mobile form 176 is movably supported upon four similar ground contacting wheel assemblies 254, 255, 256, and 257 which carry wall support beams 186 and 188 well above ground level. Wheel assemblies 254–257 are aligned and supported in a spaced relationship along inner framework 181 of side walls 178 and 180. Each assembly 254–257 includes an L-shaped mounting bracket 258 having a vertical angular member 260 attached by bolts 262 to one of vertical ribs 182 and a horizontal member 264 similarly attached to an adjacent rib 182. Wheel 266 is rotably supported by spindle 268 which is carried at one end 170 by L-shaped bracket 258 and is supported on the opposite end 272 by vertical rod 274 and horizontal bar 276, which in turn are supported by L-shaped bracket 258.

In transit, walls 178 and 180 of form 176 are held in an essentially upright posture by cross brace assembly 278 which is adjustably attached by bolts 280 between end ribs 182 of walls 178 and 180.

Referring to the drawings, in use, the following operations would be performed in the order listed to form a 2-barrel culvert:

1. Place exterior walls 12 and 14 on the concrete form within excavation 10, then space apart to the appropriate dimension (FIG. 1) and place mud sills 15 (FIG. 1) at the desired elevation under exterior walls 12 and 14.

2. Drive stakes 284 into the ground along lower outside surface 286 of each of walls 12 and 14 and secure to walls 12 and 14 by nails.

3. Plumb and brace the top edge 288 of walls 12 and 14 within excavation 10 by means of lateral interconnecting beams 290 which are secured at each end 291 by ground engaging stakes 292.

4. Use a conventional coil loop insert (not shown) secured with a bolt (not shown) laterally through hole 293 in the lower three inches of outside walls 12 and 14.

5. Engage hanger brackets 11 over outside walls 12 and 14, spaced apart the length of re-bar racks 18.

6. Insert longitudinal 2×4 supports 19 in slots 76 of each bracket 11 and secure with latch 89.

7. Place re-bar rack 18 over upper inside corner 102 of 2×4 support 19 and secure by nails 104.

8. Next, hang U-shaped re-bars 17 with connecting vertical arms 294 routed behind rack 18 and align upper arms 295 in slots 108, which results in both upper and lower arms 295 and 296 being pointed inward of walls 12 and 14.

9. Frictionally engage straight vertical re-bars 16 behind hooks 112 and over cleat 114.

10. Place lateral beams 22 and nail to hangers 11 through holes 90 (FIG. 2).

11. Space and attach the appropriate riser support brackets 156 and 158 to lateral beams 22 as shown in FIG. 1.

12. Nail riser forms 24 and 26 to brackets 156 and 158 through holes 174 (FIG. 5).

13. Position interior wall re-bar rack 28 atop and at the center 298 of lateral beams 22. Plumb and secure by vertical brace 300 to an upper lateral wall support beam 290.

14. Frictionally engage vertical re-bars 16.

15. Attach the lower ends of side wall re-bars 16 and 17 and interior wall re-bars 16 to floor reinforcing bar network 302. (Note: It is assumed that the floor re-bars are previously prepared and are not a part of the present invention).

16. Place concrete to form floor 30 to a depth equal to the lower edge 304 of riser forms 24 and 26.

17. Fill between riser forms 24 and 26 with concrete and allow concrete to cure or harden. This results in the floor configuration shown in FIG. 7.

18. After the floor is formed, all re-usable devices described above are removed in the same order as installed, resulting in the configuration shown in FIG. 7 when mobile form 176 is not shown.

Figure 7:
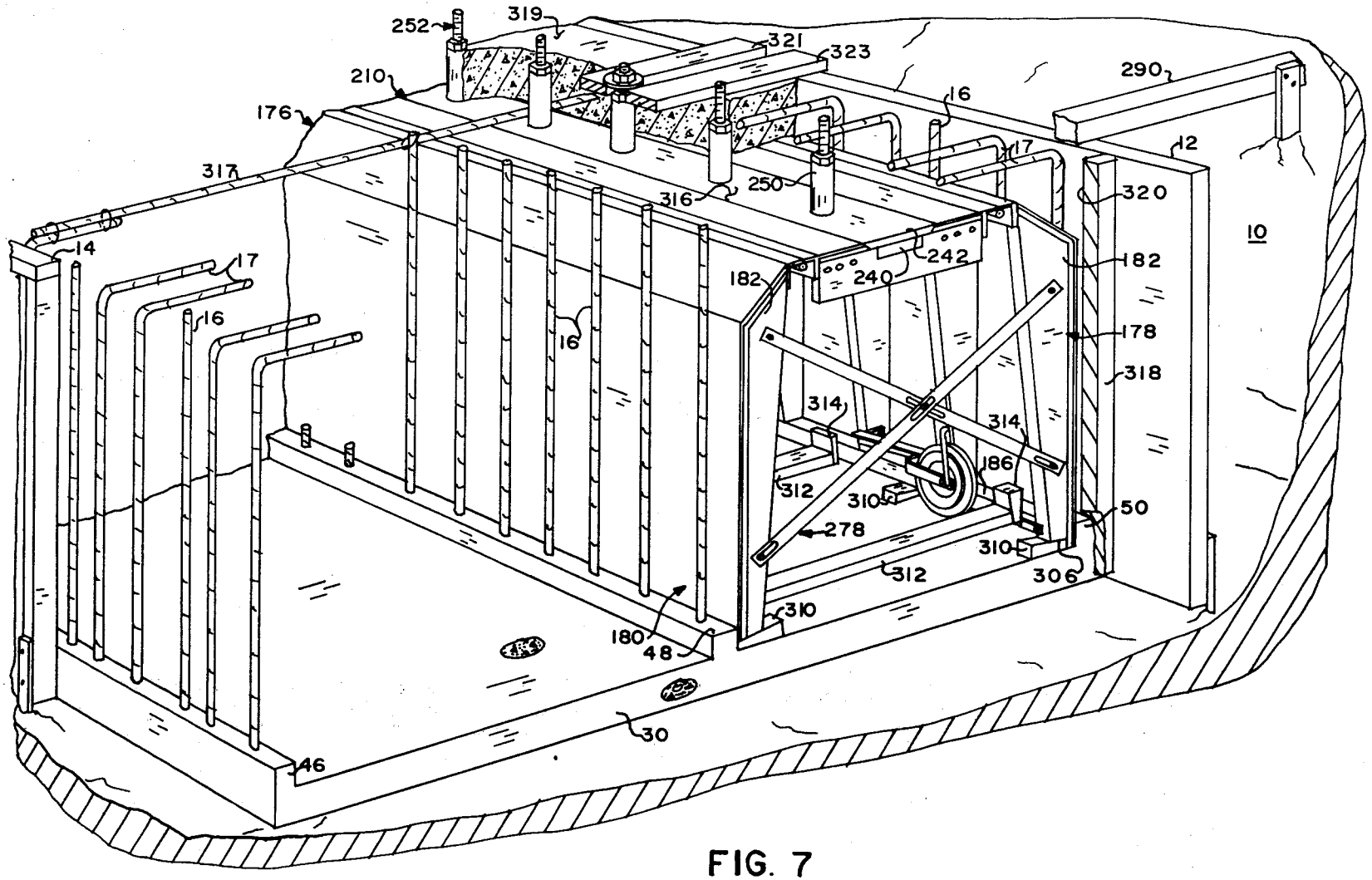
FIG. 7 illustrates a mobile interior wall assembly in position in a culvert and showing, in part, concrete poured over it.

19. Next, roll mobile interior forms 176 into position. For clarity, only one form 176 is shown in FIG. 7 in place and with lower edge region 306 of walls 178 and 180 positioned between risers 48 and 50.

20. Loosen cross brace 278 and drive spaced wedges 310 under walls 178 and 180 in order to level upper deck 210 of form 176 when also raised to the correct height above floor 30.

21. Place spaced lateral expander beam 312 between beams 186 and 188 (FIG. 6) and expand walls 178 and 180 outward into a snug engagement with risers 48 and 50 by means of wedges 314.

22. Plumb walls 178 and 180 and secure "X" brace 278.

23. Next, insert weep or drainage hole forms 250, as shown, these being lengths of tube cut to a length equal to the distance between upper surface 316 of deck 210 and the upper surface of concrete 319. Join weep hole forms 250 to central closing deck 242 by bolt assembly 252 through mating holes 248 in deck 242 and beam 240 (FIG. 8). Tighten securely.

24. Insert overhead re-bars 317 and secure as by tie wires to all vertical wall re-bars 16 and 17.

25. Position and secure wall to wall and top bulk heads, only one, 318, being shown, over the ends of form 176. This provides a lateral closing form to retain the concrete.

26. Apply concrete 319, filling each vertical wall space 320 and each deck 210 to a depth equal to the height of weep hole forms 250, and allow to set or cure.

27. Remove bulk heads 318.

28. Place divided timbers 321 and 323 on each side of bolt 252, tighten to receive load that has been supported by form 176.

29. Remove, in order, wedges 314 and 310 and expander beams 312.

30. Loosen brace 278 and tilt the lower edge 306 of walls 178 and 180 inward so as to be free of concrete dividers 48 and 50. This action lowers upper deck 210, except for central cover 242 and beam 240, which are firmly supported by bolts 252 through weep hole forms 250 now embedded in concrete and supported by divider timbers 321 and 323.

31. Roll mobile form 176 forward until clear of the now-formed barrel region 322.

32. Remove nut and bolt assembly 252 from weep hole forms 250 and remove central deck 242 with beam 240.

Having thus disclosed my invention, what is claimed is:

1. The method of construction of an elongated rectangular cross section culvert comprising:

positioning and securing in place opposite vertically positioned side wall form panels, and defining by the inner sides of these panels the extreme width of the to-beconstructed culvert;

positioning at selected spaced distances along the inner side of each said wall form panel hanger assemblies, each having a holding arm, for supporting, spaced from each wall form, a horizontal re-bar holding beam;

installing horizontal re-bar holding beams along each inner side of said panels and on said arms of a said hanger assembly, each said beam being secured to a said hanger assembly;

hanging inwardly extending, with respect to said panels, U-shaped re-bars on each said beam, with the bottom run of the "U" shape being vertical and spaced from a said wall form panel, whereby end sections of the U-shaped re-bars lie in top and bottom planes in regions of the ceiling and floor of the structure to be formed of concrete;

inserting and connecting lateral beams between a bottom region of oppositely positioned hanger assemblies;

installing riser beams horizontal and parallel to, and spaced inward of, each adjacent side wall form panel, and securing riser beams to said lateral beams, said riser beams being spaced interior of the vertical portion of said re-bars;

positioning bottom re-bars from side to side near the bottom excavation, and connecting them end to end of said U-shaped re-bars;

pouring concrete on the bottom of the excavation and between side wall form panels up to a level generally corresponding to the bottom of said riser forming beam as a floor of the culvert between the outer side of said riser forming beam, and with the concrete rising on the exterior side of the riser forming beam approximately to the top of said riser forming beam;

after the concrete is set, removing said hanger assemblies and said beams;

rolling into place a mobile interior wall form assembly comprising:

a pair of vertically extending side wall forms adapted to form interior side walls of the culvert, and a horizontal top wall form, the top wall form and side wall forms being connected, and said mobile interior wall form assembly further comprising:

at least one wheel attached to each of said vertically extending side wall forms and extending below the side wall form to which it is attached by a distance which is at a maximum less than the height of the riser of the concrete at each side above the general level of the concrete as formed by said riser beams, raising the side wall forms, generally elevating the bottom of the side edge of the side walls above the central concrete floor of the culvert, and laterally in engagement with said risers, pressing the side wall forms against said risers, extending reinforcement bars across and above the top wall form of the mobile interior wall form assembly, pouring concrete between the side wall forms of said mobile interior wall form assembly and said wall form panels and on top of said horizontal top wall form of said interior wall form assembly to complete the concrete construction of the culvert, and after the concrete has set, releasing the side wall and top wall form of the mobile interior wall form assembly and moving the whole assembly out of the thus-formed culvert, rolling it on its wheels.

* * * * *